US005724631A

United States Patent [19]

Nakao

[11] Patent Number: 5,724,631

[45] Date of Patent: Mar. 3, 1998

[54] SEAL CONSTRUCTION AND SEAL MEMBER

[75] Inventor: Koshiro Nakao, Nishiomiya, Japan

[73] Assignee: Minolta Co., Ltd., Osaka, Japan

[21] Appl. No.: 691,342

[22] Filed: Aug. 2, 1996

[30] Foreign Application Priority Data

Aug. 4, 1995 [JP] Japan ..... 7-219744

[51] Int. Cl.[6] ..... G03G 15/08

[52] U.S. Cl. ..... 399/103; 222/DIG. 1; 399/102

[58] Field of Search ..... 399/102, 103, 399/106, 262, 107; 222/DIG. 1, 541.9; 220/359, 253, 255, 265, 268, 269; 215/258

[56] References Cited

U.S. PATENT DOCUMENTS

| | | | |
|---|---|---|---|
| 3,999,654 | 12/1976 | Pollack | 222/DIG. 1 |
| 4,930,684 | 6/1990 | Patterson | 222/DIG. 1 |
| 5,080,745 | 1/1992 | Paull | 222/DIG. 1 |
| 5,150,807 | 9/1992 | Seyfried et al. | 141/364 X |
| 5,177,540 | 1/1993 | Honda et al. | 399/106 |
| 5,184,182 | 2/1993 | Michlin | 399/262 |
| 5,258,814 | 11/1993 | Davies | 222/DIG. 1 |
| 5,282,003 | 1/1994 | Michlin | 399/103 |
| 5,296,902 | 3/1994 | Michlin | 399/109 |
| 5,383,009 | 1/1995 | Tsusaka . | |
| 5,412,364 | 5/1995 | Iguchi et al. . | |
| 5,434,656 | 7/1995 | Nagaoka et al. . | |
| 5,488,462 | 1/1996 | Ishikawa et al. . | |
| 5,523,828 | 6/1996 | De Kesel | 399/103 |
| 5,585,895 | 12/1996 | Yashiro et al. | 399/103 |

FOREIGN PATENT DOCUMENTS

| | | |
|---|---|---|
| 0 634 707 | 1/1995 | European Pat. Off. . |
| 138723 | 5/1994 | Japan . |

*Primary Examiner*—Matthew S. Smith
*Attorney, Agent, or Firm*—McDermott, Will & Emery

[57] ABSTRACT

A sealing member for a developer supply container in the form of a two-sided tape constructed of adhesive layers attached to the opposite sides of a substrate with adhesive. A thin film member is attached to one of the adhesive layers. The other adhesive layer is attached to the periphery of an aperture of a developer supply container to seal the aperture. The strength of the substrate is less than the adhesive strength of the adhesive layers relative to the film member and the developer supply container. When the developer supply container is placed in an image forming apparatus, the aperture is opened by pulling the film member. As a result, the film member is peeled from the developer supply container and part of the substrate is removed from both adhesive layers along a layer surface of the tape, with one side of the separated substrate remaining attached to the periphery of the aperture of the developer supply container and the other side of the separated substrate being pulled out with the film member.

19 Claims, 11 Drawing Sheets

SEAL CONSTRUCTION AND SEAL MEMBER

BACKGROUND OF THE INVENTION

1. Field of the Invention

The present invention relates to a seal construction for a container, and specifically relates to a seal construction and seal member for a developer supplying container in an image forming apparatus such as a copying apparatus and the like.

2. Description of the Related Art

In recent years, image forming units, which integratedly house a photosensitive member, developing devices and developer container to supply developer to said developing devices, have come to be used in image forming apparatuses such as copying apparatuses, printers and the like to make the apparatus more compact and allowing for easy maintenance of the apparatus.

U.S. Pat. No. 5,412,364 discloses a toner pack internally accommodating toner and sealed by a film member thermocompressed on the periphery of a supply aperture, used as a developer supply container in the aforesaid imaging forming unit. The toner accommodated in the toner pack is supplied to the interior of the image forming unit via the toner pack aperture and toner inlet of the image forming unit by peeling off the aforesaid film member, after the toner pack is installed, with the sealed surface of the toner pack facing the toner inlet of the image forming unit.

The operation of thermocompressing the film member around the periphery of the supply aperture of the toner pack is inconvenient. A further disadvantage is that the material of the film member is limited to thermally fusible material because the film member is thermally fused as pressure is applied on the periphery of the supply aperture of the toner pack.

When a film member is thermocompressed to the periphery of the toner pack supply aperture, it is difficult to adjust the bonding strength of the film member. As a result, there is a danger of the film breaking before being completely peeled off when the film member is removed from the toner pack.

An image forming unit has been proposed, which uses adhesive tape having an adhesive application on a specific surface as a seal member sealing the supply aperture of a developer supply container.

FIGS. 1 through 3 show a seal construction and seal member for the toner supply aperture of developer supply container 120 in the aforesaid conventional image forming unit.

Until the image forming unit is installed in the image forming apparatus, the supply aperture 121 of developer supply container 120 is sealed by tape-like film member 140 adhered thereto as shown in FIGS. 1 and 2, so as to prevent the developer accommodated within developer supply container 120 from spilling from supply aperture 121. When the image forming unit is installed in the image forming apparatus, the aforesaid film member 140 is pulled through pull-out aperture 122 of developer supply container 120 which is sealed by an attached elastic seal member (not illustrated) of urethane foam or the like used to prevent developer discharge into the apparatus interior, as shown in FIG. 3, so as to peel said film member 140 from developer supply container 120 to open supply aperture 121, and allow developer to flow from developer supply container 120 through supply aperture 121 into the image forming unit.

When the adhesive tape film member 140, is pulled through pull-out aperture 122, which is sealed by an elastic or flexible seal member used to prevent developer discharge, there is a possibility that the elastic seal member provided on pull-out aperture 122 may cling to the adhesive surface of said adhesive tape so as to damage a part of the elastic seal member, or the adhesive tape and seal member may be pulled from pull-out aperture 118 together, such that developer spills from the image forming unit through said pull-out aperture 122.

However, none of the conventional adhesive tapes described above, used to seal an aperture of a developer supply container, provide the important advantages of opening the aperture without damaging a portion of the elements used to seal the aperture while opening the aperture during the installation of the developing supply container in an copying apparatus.

SUMMARY OF THE INVENTION

A main object of the present invention is to provide a seal construction and seal member, which allow for the easy sealing of a toner supply aperture of a develop supply container.

Another object of the present invention is to provide a seal construction and seal member which allows a seal member of a toner supply aperture of a developer supply container to be removed without damaging an elastic seal member used for preventing developer discharge from a said container.

A further object of the present invention is to provide a toner supply aperture of a developer supply container and a seal member, which allow easy reuse of a developer supply container.

As pointed in greater detail below, the seal construction according to the present invention comprises, a first adhesive layer for adhering to for example, the periphery of a developer supply aperture of a developer supply container, a second adhesive layer for adhering to a film member, and a substrate having the first adhesive layer and the second adhesive layer on bilateral sides thereof, said substrate being separated on both sides of the first adhesive layer and the second adhesive layer along the layer surface.

Further as pointed out in greater detail below, the seal construction and seal member according to the present invention provide the important advantages of when an adhesive member is attached to a developer supply container to seal the supply aperture of the developer supply container, the adhesive film member is attached by two-sided tape to the periphery of the supply aperture of the developer supply member, and the attachment of the film member is extremely easy compared a conventional seal construction, wherein a film member is thermally fused to the periphery of the supply aperture as pressure is applied. Also, the seal described herein provides the excellent advantage of allowing the developer supply container to be readily used again.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
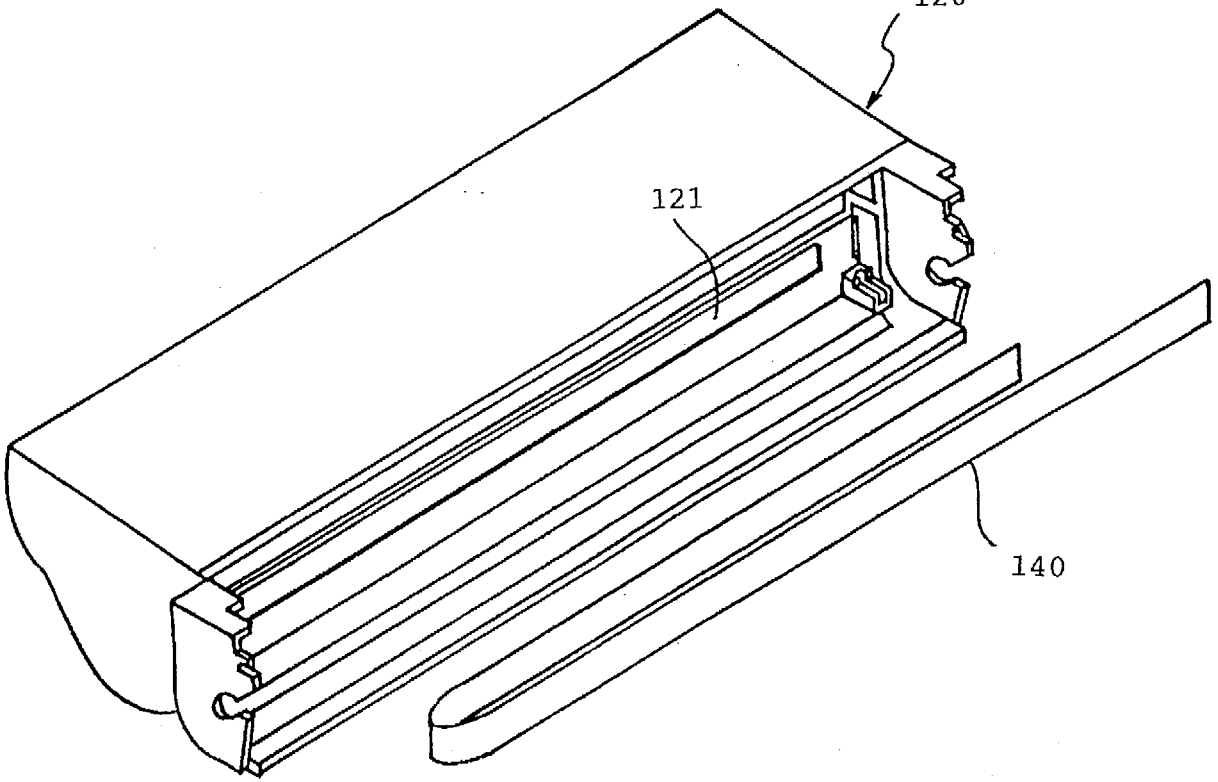
Fig.1 Prior Art
FIG. 1 is a brief perspective view showing a conventional example of a supply aperture of a developer supply container sealed by a film member.
Figure 2:
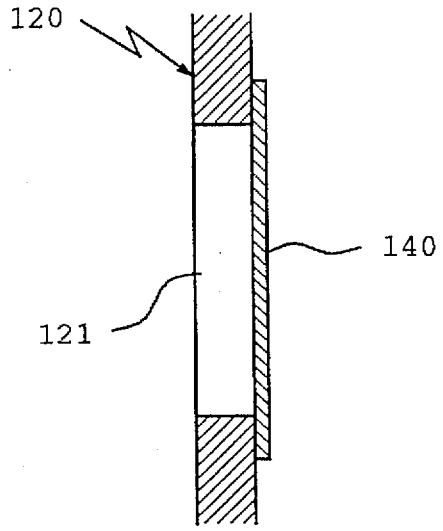
Fig.2 Prior Art
FIG. 2 is a partial section view showing a conventional example of a supply aperture of a developer supply container sealed by a film member.
Figure 3:
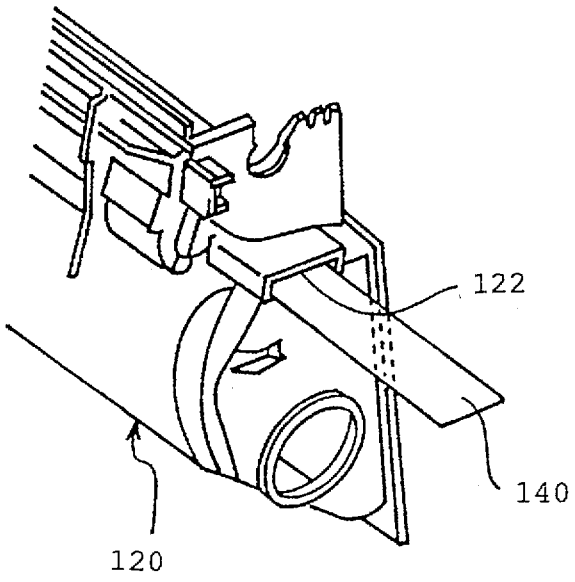
Fig.3 Prior Art
FIG. 3 is a partial view showing a film member peeled from a pull-out aperture of a developer supply container.
Figure 4:
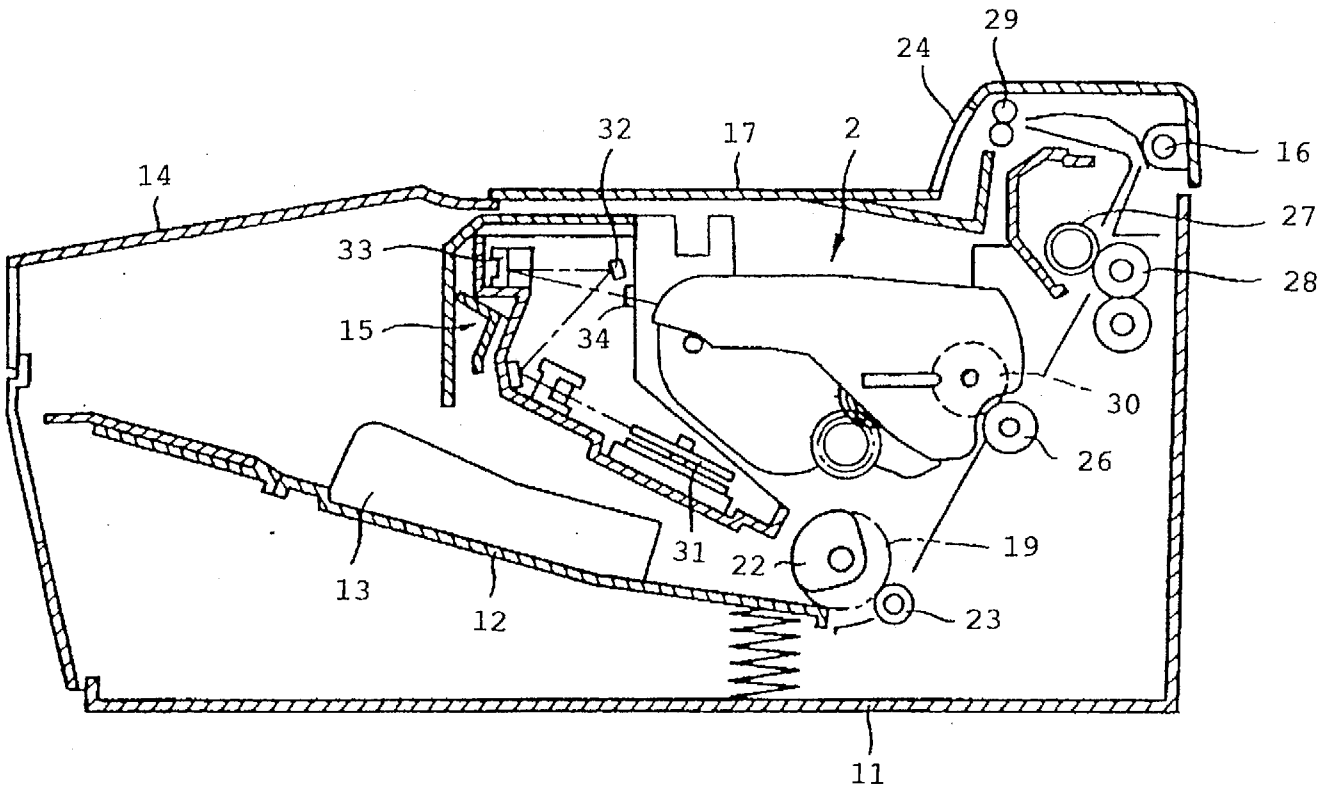
FIG. 4 shows a laser printer provided with an image forming unit using a seal construction and seal member for a developer supply container of the present invention.

FIG. 4 briefly shows the overall construction of a laser printer provided with an image forming unit using a seal construction and seal member of a developer supply container of the present invention.

A sheet receptacle or tray 12 is built into the bottom of printer body 11, and recording sheets are stacked on said sheet receptacle 12 in a downward facing inclined state. When long recording sheets such as legal size sheets are accommodated in sheet receptacle 12, the leading edge of sheet receptacle 12 is pushed out so as to extend to the exterior of the printer body. A width regulating panel 13 is provided on sheet receptacle 12 to regulate the recording sheet in the width direction. A front cover 14 is mounted on printer body 11 so as to be operable to provide easy loading of the recording sheet receptacle 12.

A laser scanning unit 15 is provided in the central area of printer body 11, and a cover 17 is mounted so as to be oscillatable or pivotable about hinge 16 provided on the back edge of printer body 11, so as to removably install image forming unit 2 at a position below cover 17. A pressing member or spring member (not illustrated) is attached to the interior side of cover 17 to constrain image forming unit 2 when the image forming unit 2 is installed in printer body 11. A locking mechanism (not illustrated) is provided on cover 17, such that cover 17 is locked to apparatus body 11 when said cover 17 is closed, and said cover 17 can be opened when the lock is released.

Recording sheets stacked on sheet receptacle 12 are fed one sheet at a time via feed roller 19 and cam 22, and pinch roller 23 in contact with the roller 19. The sheets are transported while being guided by guide members (not shown) so as to be discharged from opening 24 formed on cover 17 and be deposited on top of said cover 17.

A rotatable photosensitive drum 30 is provided in image forming unit 2, and a rotatable transfer roller 26 is provided in printer body 11 to transfer an electrostatic latent image formed on photosensitive drum 30 to a recording sheet. Fixing rollers 27 and 28 are provided in printer body 11 to thermally fuse the transfer image to the recording sheet. A pair of discharge rollers 29 are mounted on the interior side of cover 17 to eject a recording sheet bearing a formed image through discharge aperture 24 onto cover 17.

Optical unit 15 is provided with well known elements including a polygonal mirror 31, which is irradiated by light emitted from a light source comprising a semiconductor laser and collimator lens (not illustrated), a folding mirror 32, and toroidal mirror 33. A laser beam emitted from the optical unit 15 passes through glass 34 provided at a window, and irradiates the photosensitive drum 30.

Figure 5:
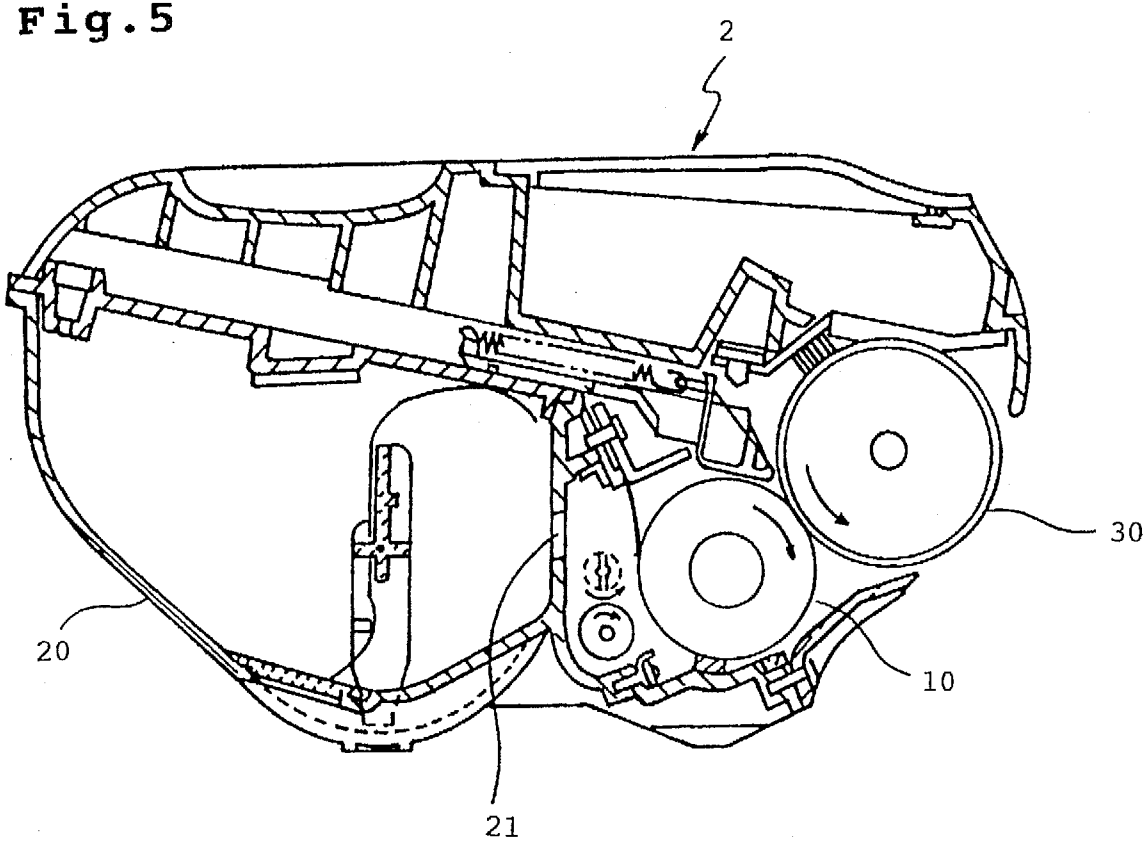
FIG. 5 shows image forming unit 2.

The construction of image forming unit 2 in the laser printer is described hereinafter with reference to FIG. 5. In addition to photosensitive drum 30, image forming unit 2 integratedly houses a developing device 10, and developer supply container 20 which supplies developer to developing device 10.

In image forming unit 2, a narrow slot-like supply aperture 21 is provided on the developer supply container 20 in order to supply the developer accommodated in the developer supply container 20 to the developing device 10.

First Embodiment

The seal construction and seal member of the developer supply container of the first embodiment of the invention is described below with reference to FIGS. 6–14.

In the first embodiment, a film member 4 is attached to developer supply container 20, and a two-sided tape 40 is used as a seal member for sealing supply aperture 21 of the developer supply container 20, said two-sided tape 40 having adhesive layers 42*a* and 42*b* formed bilaterally on a substrate 41, said substrate 41 separating both adhesive layers 42*a* and 42*b* along the layer surface direction.

Two-sided tape 40 comprises adhesive layers 42*a* and 42*b* formed of adhesive on bilateral sides of substrate 41, said substrate 41 comprising a material such as, for example, soft paper or the like, which separates both adhesive layers 42*a* and 42*b* along the layer surface.

Figure 8A:
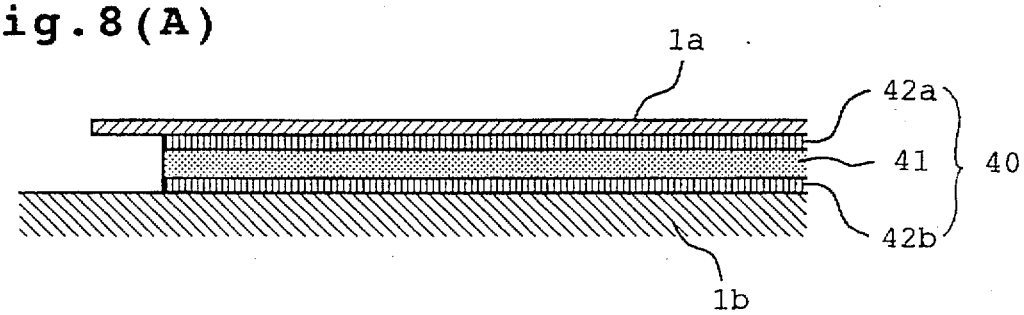
FIG. 8(A) is a section view showing bonded members in a mutually bonded state by the two-sided tape of the present invention.

The mutual bonding of adhered members 1*a* and 1*b* by the aforesaid two-sided tape 40 is accomplished by bonding the adhered layers 1*a* and 1*b* by the adhesive layer 42*a* and 42*b* of two-sided tape 40, as shown in FIG. 8(A). In this example, a sheet-like adhered member l*a* is adhered to adhesive layer 42*a* on one side of the two-sided tape 40.

Figure 8B:
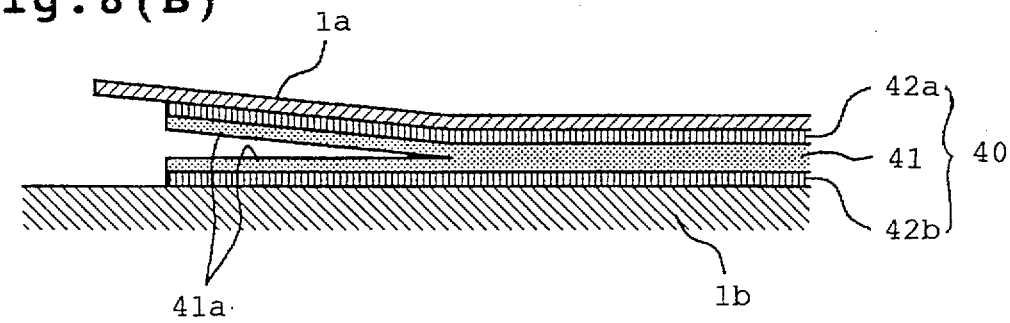
FIG. 8(B) is a section view showing mutually bonded members in a separated state.

The separation of mutually adhered members 1*a* and 1*b* bonded by two-sided tape 40 as described above is accomplished by pulling sheet-like adhered member 1*a*, which is adhered to adhesive layer 42*a* on one side of two-sided tape 40 as shown in FIG. 8(B). The substrate 41 of two-sided tape 40 is separated from bilateral adhesive layers 42*a* and 42*b* along the layer surface between adhesive layer 42*a* bonded to sheet-like adhered member l*a* and adhesive layer 42*b* bonded to the other side, such that a nonadhesive separation surface 41*a* is exposed. In the two-sided tape 40 of the aforesaid construction, the adhesive strength of adhered members 1*a* and 1*b* relative to adhesive layers 42*a* and 42*b* may be greater than the strength of substrate 41.

Figure 9:
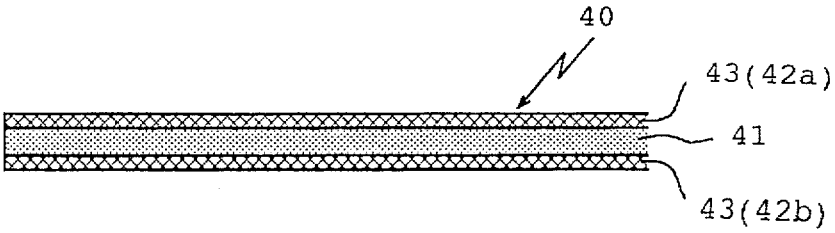
FIG. 9 is a section view showing another embodiment of the two-sided tape of the present invention.

Although the two-sided tape 40 described above is constructed of adhesive layers 42*a* and 42*b* adhered to both sides of substrate 41 via adhesive, two-sided tape 40 is not limited to this construction and, for example, may be constructed by a two-sided sheet 43 provided with bilateral adhesive layers which is attached to both sides of said substrate 41 so as to form adhesive layers 42*a* and 42*b* on bilateral sides of said substrate 41, as shown in FIG. 9.

Figure 10A:
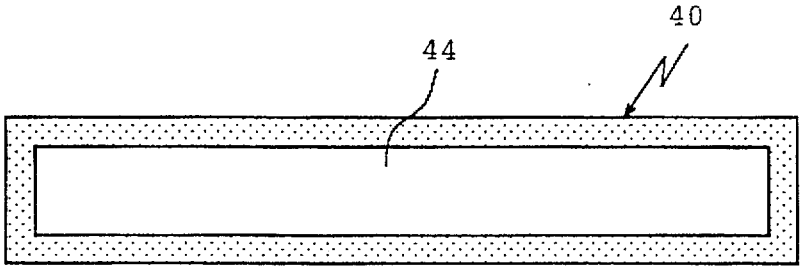
FIGS. 10(A) and 10(B) are a top view and section view, respectively, showing the two-sided tape used in a seal construction of a developer supply container of a first embodiment.
Figure 10B:
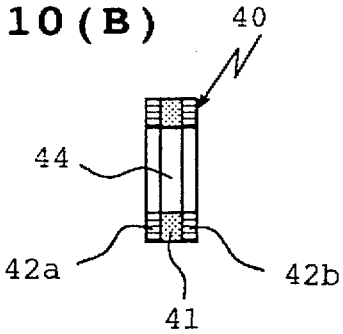

In the first embodiment of the present invention, a quadrangular ring-like member having an open portion 44 corresponding to supply aperture 21 of developer supply container 20 is used as the aforesaid two-sided tape 40, as shown in FIGS. 10(A) and 10(B).

Figure 6:
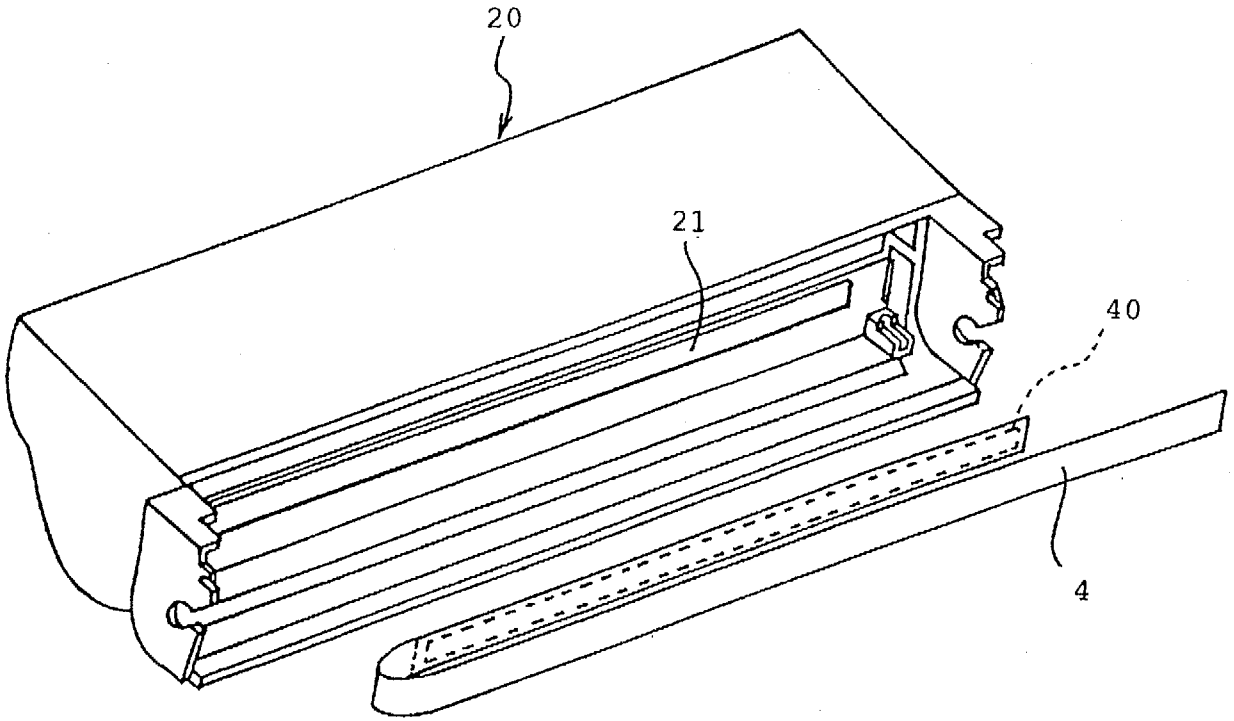
FIG. 6 is a perspective view showing a film member attached to a developer supply container to seal the supply aperture of a developer supply container in a seal construction of a developer supply container of a first embodiment.
Figure 7:
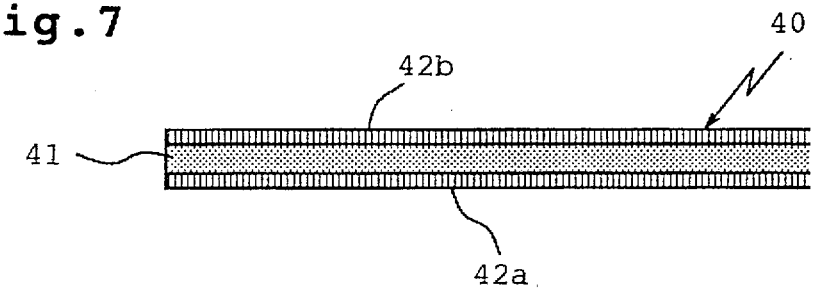
FIG. 7 is a section view of a two-sided tape of a first embodiment of the present invention.
Figure 11:
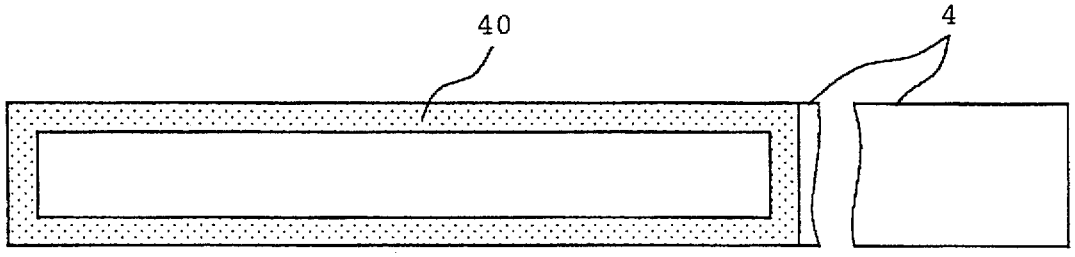
FIG. 11 is a top view showing two-sided tape adhered to a film member in a developer supply container seal construction of a first embodiment.
Figure 12A:
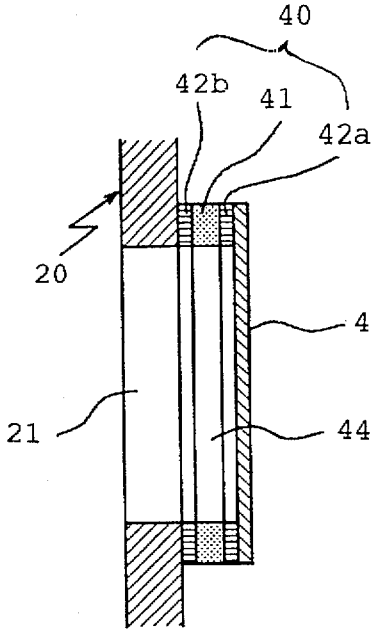
FIGS. 12(A) and 12(B) are respective section views showing a developer supply container seal construction of a first embodiment, wherein two-sided tape is attached to the periphery of a supply aperture of a developer supply container, said views showing a film member sealing the supply aperture and said film member removed from the developer supply container.

FIG. 11 shows a film member 4 adhered to the adhesive layer 42*a* on a unilateral surface of said two-sided tape 40, and in this state the adhesive layer 42*b* of the contralateral surface of said two-sided tape 40 is adhered to the periphery of supply aperture 21 of developer supply container 20 as shown in FIGS. 6 and 12(A), so as to seal said supply aperture 21 of developer supply container 20 via said film member 4. In the first embodiment, the strength of substrate 41 of two-sided tape 40 is less than adhesive strength of adhesive layers 42*a* and 42*b* relative to film member 4 and developer supply container 20.

Figure 14:
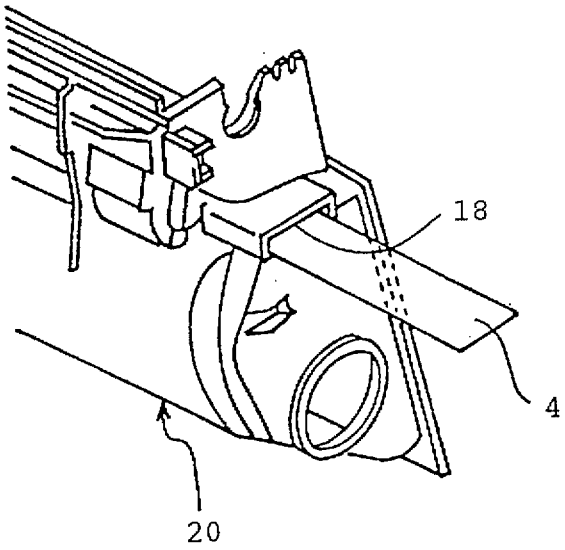
FIG. 14 shows a film member 4 removed from pull-out aperture 22 in the developer supply container of the first embodiment.

When image forming unit 2 is installed in the image forming apparatus with the supply aperture 21 of developer supply container 20 in a sealed state via film member 4, said supply aperture 21 is opened by pulling film member 4 through pull-out aperture 18 of developer supply container 20, which has an attached flexible seal member to prevent developer discharge into the apparatus, thereby opening supply aperture 21 as said film member 4 is peeled from developer supply container 20, as shown in FIG. 14.

Figure 12B:
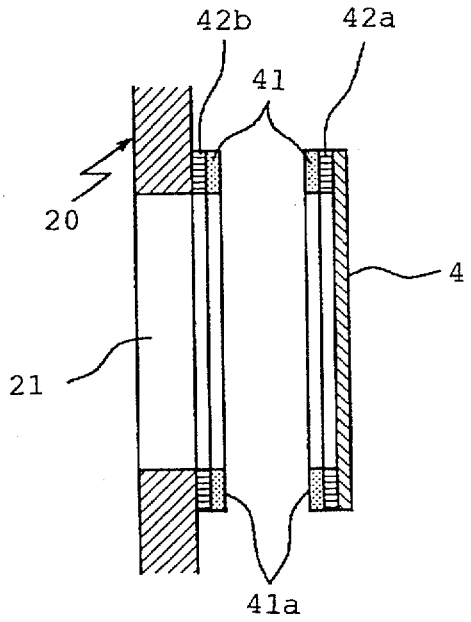
Figure 13:
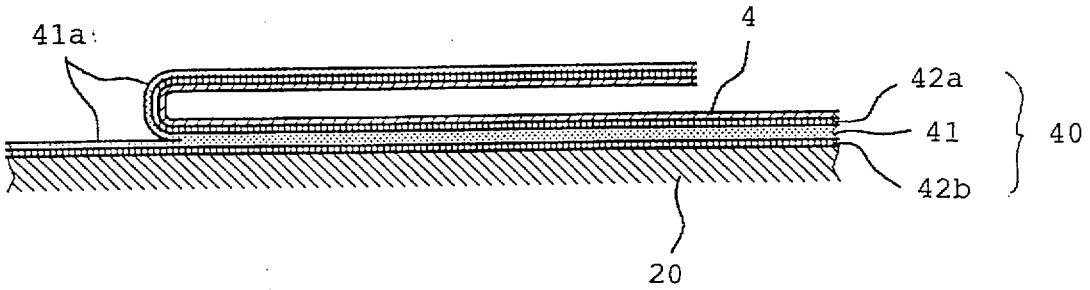
FIG. 13 is a section view showing a film member attached to a developer supply container removed from said developer supply container in a seal construction of a developer supply container.

When film member 4 is peeled from developer supply container 20, part of the substrate 41 is removed from both adhesive layers 42*a* and 42*b* along the layer surface in the two-sided tape 40 adhered to film member 4 and developer supply container 20 as shown in FIGS. 12(B) and 13, and one side of the separated substrate 41 remains adhered to the periphery of supply aperture 21, whereas the other side of separated substrate 41 is pulled through pull-out aperture 22 still adhered to film member 4.

When part of substrate 41 of the aforesaid two-sided tape 40 is separated on both sides of adhesive layers 42*a* and 42*b*, a nonadhesive separation surface 41*a* is exposed on substrate 41 by said separations, and when film member 4 is pulled from pull-out aperture 18 with the adhered substrate 41 separated from film member 4, the flexible seal member provided on pull-out aperture 18 does not cling to said film member 4.

Thus, according to the seal construction and seal member of the developer supply container of the first embodiment, whenever film member 4 is pulled from pull-out aperture 18 to open supply aperture 21, spillage of developer from pull-out aperture 22 is prevented because part of the flexible seal member provided on pull-out aperture 18 is not broken and said flexible seal member is not pulled from pull-out aperture 18 together with film member 4.

Although the two-sided tape 40, with film member 4 in a state of attachment therewith, seals supply aperture 21 of developer supply container 20 via film member 4 adhered to the periphery of said supply aperture 21 of developer supply container 20 in the first embodiment, it is to be noted that two-sided tape 40 may be first adhered to the periphery of supply aperture 21 of developer supply container 20 and thereafter film member 4 may be adhered to said two-sided tape 40 to seal supply aperture 21 of developer supply container 40 via film member 4.

Second Embodiment

The seal construction and seal member of a developer supply container of a second embodiment of the invention is described below with reference to FIGS. 15(A)–17.

Figure 15A:
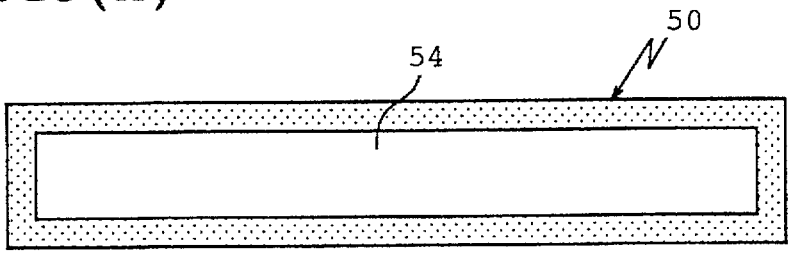
FIGS. 15(A) and 15(B) are a top view and section view, respectively, of two-sided tape used in a seal construction of a developer supply container of a second embodiment of the invention.
Figure 15B:
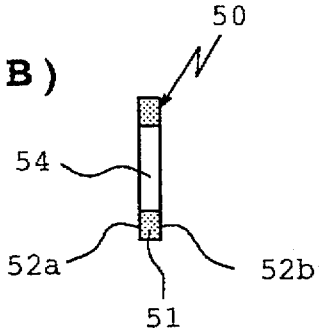

In the second embodiment, two-sided tape 50 comprising adhesive surfaces 52*a* and 52*b* bilaterally provided on substrate 51 is used as a seal member for sealing supply aperture 21 of the developer supply container 20, which is attached a film member 4, as shown in FIGS. 15(A) and 15(B). Two-sided tape 50 is a quadrangular ring-like member the center portion of which is provided with an open portion 54 corresponding to the shape of supply aperture 21 of developer supply container 20.

Figure 16A:
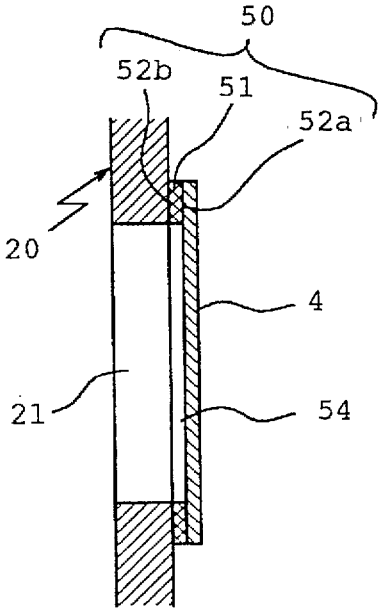
FIGS. 16(A) and 16(B) are respective section views showing a developer supply container seal construction of a second embodiment, wherein two-sided tape is attached to the periphery of a supply aperture of a developer supply container, said views showing a film member sealing the supply aperture and said film member removed from the developer supply container.

In the second embodiment, film member 4 is adhered to adhesive surface 52*a* on one side of two-sided tape 50, so as to be removable therefrom. An adhesive surface 52*b* provided on the contralateral side of two-sided tape 50 is adhered to the periphery of supply aperture 21 of developer supply container 20 as shown in FIG. 16(A), so as to seal said supply aperture 21 of developer supply container 20 via said film member 4. In the second embodiment, the adhesive strength of two-sided tape 50 relative to developer supply container 20 is high, whereas the adhesive strength of two-sided tape 50 relative to film member 4 is weak, such that film member 4 can be readily peeled from two-sided tape 50. In order to have a stronger adhesive strength of two-sided tape 50 relative to developer supply container 20 and a weaker adhesive strength of two-sided tape 50 relative to film member 4, the material of developer supply container 20 and the material of film member 4 may have different adhesive strengths relative to adhesive surfaces 52*a* and 52*b* of two-sided tape 50, different types of adhesive may be used for the respective adhesive surfaces 52*a* and 52*b* of two-sided tape 50, and the shape of the surfaces of the film member 4 and developer supply container 20 adhered to adhesive surfaces 52*a* and 52*b* of two-sided tape 50 may be changed so as to change the adhesive strength of adhesive surfaces 52*a* and 52*b* of two-sided tape 50.

When image forming unit 2 is installed in the image forming apparatus with the supply aperture 21 of developer supply container 20 in a sealed state via film member 4, said supply aperture 21 is opened by pulling film member 4 through pull-out aperture 18 of developer supply container 20, which has an attached flexible seal member to prevent developer discharge into the apparatus, thereby opening supply aperture 21 as said film member 4 is peeled from developer supply container 20, as shown in FIG. 14.

Figure 16B:
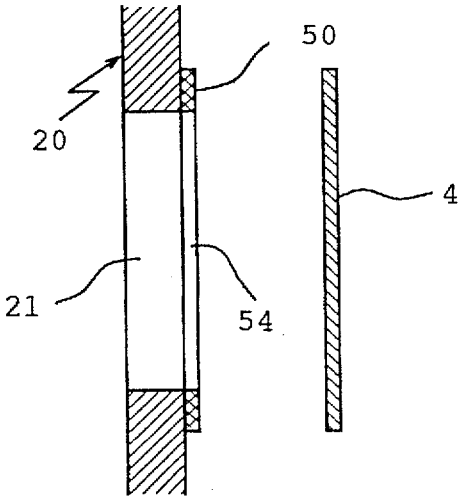
Figure 17:
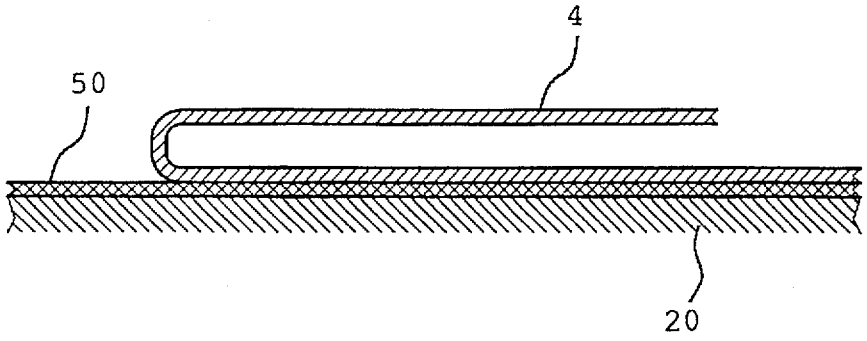
FIG. 17 is a section view showing the seal construction of a developer supply container of the second embodiment, wherein the film member is peeled from the two-sided tape.

When film member 4 is peeled from developer supply container 20, two-sided tape 50 remains adhered to developer supply container 20 because the adhesive strength of film member 4 is weak relative to adhesive surface 52*a* of two-sided tape 50 as shown in FIGS. 16(B) and 17, and only film member 4 is peeled from developer supply container 20 and pulled through pull-out aperture 22 without the flexible seal member provided on pull-out aperture 22 clinging to film member 4.

Thus, the second embodiment of the invention provides, in the same manner as the first embodiment, that whenever film member 4 is pulled from pull-out aperture 22 to open supply aperture 21, spillage of developer from pull-out aperture 22 is prevented because part of the flexible seal member provided on pull-out aperture 18 is not broken and said flexible seal member is not pulled from pull-out aperture 22 together with film member 4.

Although two-sided tape 40 is used as a seal member for supply aperture 21 of developer supply container 20 in the first embodiment of the invention, use of said two-sided tape 40 is not limited to use as a seal member.

For example, an address label for envelope or parcel, or video tape index label may be alternatively used.

After adhering two-sided tape 40 to an envelope or parcel and writing an address on the surface thereof, the tape surface payer may be peeled away to expose a new surface such that the envelope or parcel may be reused by writing an address or the like on said new surface. Since a new surface is exposed by peeling away the tape surface layer similar to a video tape index label, new data can be recorded on the label.

Two-sided tape 40 may also be used as sealing tape for envelopes and packages.

When two-sided tape 40 is used to seal envelopes and packages, the envelope and packet can be opened without damage, thus allowing reuse of the envelope.

Furthermore, in the seal construction of the developer supply container of the first and second embodiment of the invention, when the film member is attached to developer supply container to seal the supply aperture of the developer supply container, the film member is attached by two-sided tape to the periphery of the supply aperture of the developer supply member, and the attachment of the film member is extremely easy compared a conventional seal construction wherein a film member is thermally fused to the periphery of the supply aperture as pressure is applied. Even when the developer supply container is reused, it is simple to seal the supply aperture of the developer supply container via a film member when a cover is provided, thereby allowing the developer supply container to be readily used again.

Although the present invention has been fully described by way of examples with reference to the accompanying drawings, it is to be noted that various changes and modification will be apparent to those skilled in the art. Therefore, unless otherwise such changes and modification depart from the scope of the present invention, they should be construed as being included therein.

What is claimed is:

1. A seal construction for sealing an aperture, comprising:

a first adhesive layer for attachment to a periphery of an aperture;

a second adhesive layer adhering to a film member; and a substrate having the first adhesive layer and the second adhesive layer on bilateral sides thereof, said substrate being capable of splitting and staying partially adhered to the first adhesive layer and the second adhesive layer.

2. The seal construction according to claim 1, wherein strength of the substrate is less than adhesive strength of the first adhesive layer relative to the periphery of the aperture and the adhesive strength of the second adhesive layer relative to the film member.

3. The seal construction according to claim 1, wherein the substrate is formed of a material such as a soft paper.

4. The seal construction according to claim 1, wherein each of the first adhesive layer and the second adhesive layer is formed of adhesive.

5. The seal construction according to claim 1, wherein each of the first adhesive layer and the second adhesive layer is formed of a bilateral adhesive layer, one surface of which is adhered to the substrate.

6. The seal construction according to claim 1, wherein the substrate is a quadrangular ring-like member having an open portion corresponding to the aperture.

7. A seal construction for sealing a developer supply aperture of a developer supply container for use in an image forming apparatus, said seal construction comprising:

a first adhesive layer for attachment to a periphery of a developer supply aperture of a developer supply container;

a second adhesive layer adhering to a film member; and a substrate having the first adhesive layer and the second adhesive layer on bilateral sides thereof, said substrate being capable of splitting and staying partially adhered to the first adhesive layer and the second adhesive layer.

8. The seal construction according to claim 7, wherein strength of the substrate is less than adhesive strength of the first adhesive layer relative to the developer supply container and the adhesive strength of the second adhesive layer relative to the film member.

9. The seal construction according to claim 7, wherein the substrate is formed of a material such as a soft paper.

10. The seal construction according to claim 7, wherein each of the first adhesive layer and the second adhesive layer is formed of adhesive.

11. The seal construction according to claim 7, wherein each of the first adhesive layer and the second adhesive layer is formed of a bilateral adhesive layer one surface of which is adhered to the substrate.

12. The seal construction according to claim 7, wherein the substrate is a quadrangular ring-like member having an open portion corresponding to the developer supply aperture of the developer supply container.

13. The seal construction according to claim 7, wherein said developer supply container is accommodated in an image forming unit internally with a developing device and a photosensitive drum.

14. A seal member comprising:

a first adhesive layer;

a second adhesive layer; and a substrate which has the first adhesive layer and the second adhesive layer on bilateral sides thereof, said substrate being capable of splitting and staying partially adhered to the first adhesive layer and the second adhesive layer.

15. The seal member according to claim 14, wherein said substrate is formed of a material such as a soft paper.

16. The seal member according to claim 14, wherein each of the first adhesive layer and the second adhesive layer is formed of adhesive.

17. The seal member according to claim 14, wherein each of the first adhesive layer and the second adhesive layer is formed of a bilateral adhesive layer one surface of which is adhered to the substrate.

18. A method of sealing an aperture, comprising the steps of:

attaching one side of a first adhesive layer to a periphery of an aperture;

attaching one side of a second adhesive layer to a film member; and attaching another side of said first adhesive layer and another side of said second adhesive layer to the bilateral sides of a substrate, said substrate being capable of splitting and staying partially adhered to the first adhesive layer and the second adhesive layer.

19. The method of sealing an aperture according to claim 18, wherein the strength of said substrate is less than the adhesive strength of said first adhesive layer relative to the periphery of the aperture and the adhesive strength of said second adhesive layer relative to the film member.

* * * * *